United States Patent [19]

Petree

[11] Patent Number: 4,997,041

[45] Date of Patent: Mar. 5, 1991

[54] METHOD FOR SELECTIVELY OPERATING A WIRELINE TOOL RELEASING DEVICE

[75] Inventor: Allen R. Petree, Dubai, United Arab Emirates

[73] Assignee: Conoco Inc., Houston, Tex.

[21] Appl. No.: 464,484

[22] Filed: Jan. 11, 1990

Related U.S. Application Data

[62] Division of Ser. No. 290,671, Dec. 27, 1988, Pat. No. 4,909,321.

[51] Int. Cl.[5] ..... E21B 23/00

[52] U.S. Cl. ..... 166/377; 166/378; 166/385

[58] Field of Search ..... 166/377, 378, 380, 381, 166/385, 72

[56] References Cited

U.S. PATENT DOCUMENTS

| | | | |
|---|---|---|---|
| 2,266,382 | 12/1941 | Quintrell et al. | 166/63 |
| 4,275,786 | 6/1981 | Lee | 166/65.1 X |
| 4,333,542 | 6/1982 | Taylor | 175/299 |
| 4,422,508 | 12/1983 | Rutledge, Jr. et al. | 166/377 X |
| 4,685,516 | 8/1987 | Smith et al. | 166/65.1 |
| 4,877,089 | 10/1989 | Burns | 166/377 |

FOREIGN PATENT DOCUMENTS

| | | | |
|---|---|---|---|
| 198672 | 10/1986 | European Pat. Off. | 166/65.1 |

*Primary Examiner*—Hoang C. Dang

*Attorney, Agent, or Firm*—John E. Holder; Richard K. Thomson

[57] ABSTRACT

An apparatus and method for selectively disconnecting a wireline from a downhole tool when the tool becomes lodged in an oil or gas well. The apparatus is directed to a wireline releasing device which includes a precharge chamber which can be pressurized to a predetermined amount for applying a force against a piston assembly located within the releasing device to hold together telescopically connected upper and lower tubular portions which are locked in place by retractable dogs which extend through aligned openings in the upper and lower tubular portions. The device is intended to be connected at one end to a length of wireline and, to another end, to the top of the downhole tool. During wireline operations, upon the downhole tool becoming lodged within the well, the wireline operator applies hydraulic or pneumatic pressure from the surface which exceeds the precharged pressure, which acts to disconnect the upper portion of the device from the lower portion and the downhole tool.

11 Claims, 5 Drawing Sheets

FIG. 4A
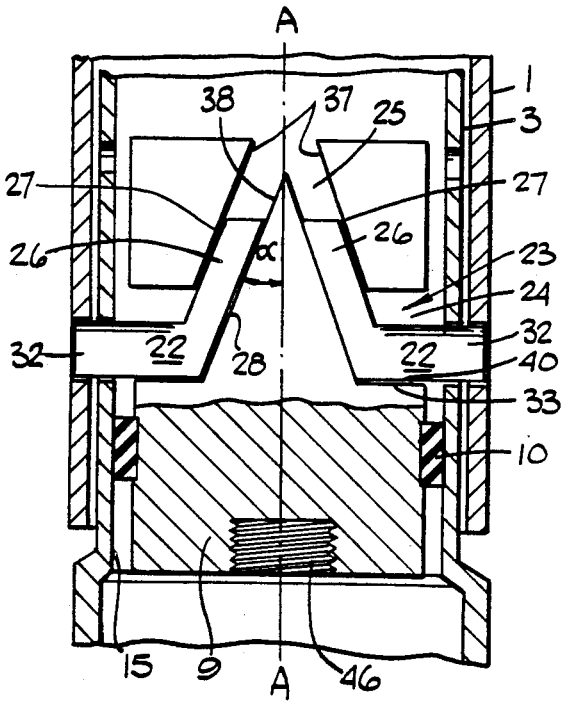
FIG. 4B
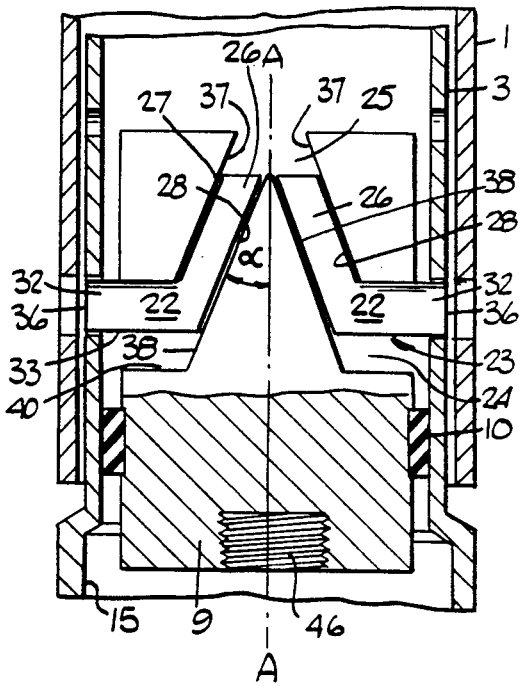
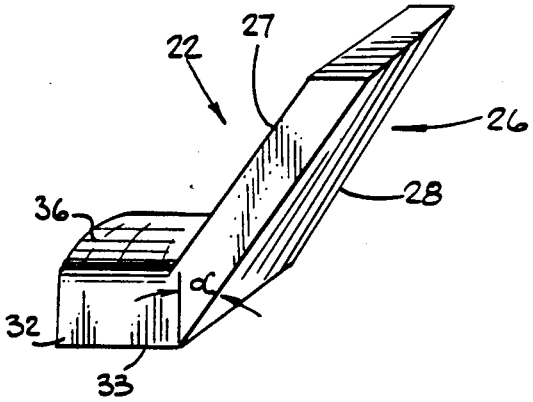
FIG 5
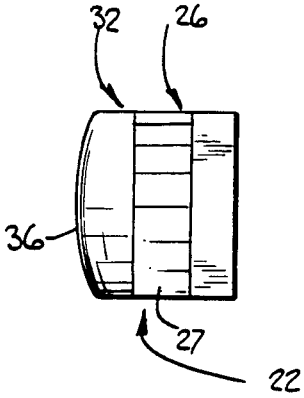
FIG. 6

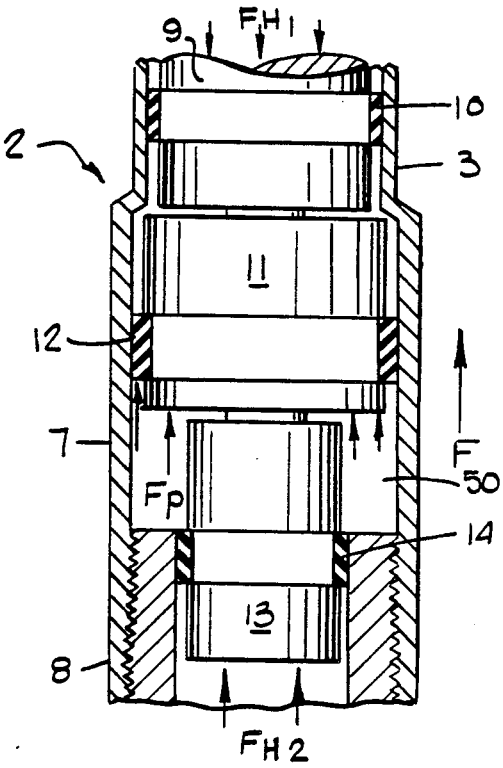
FIG. 7
FIG. 8
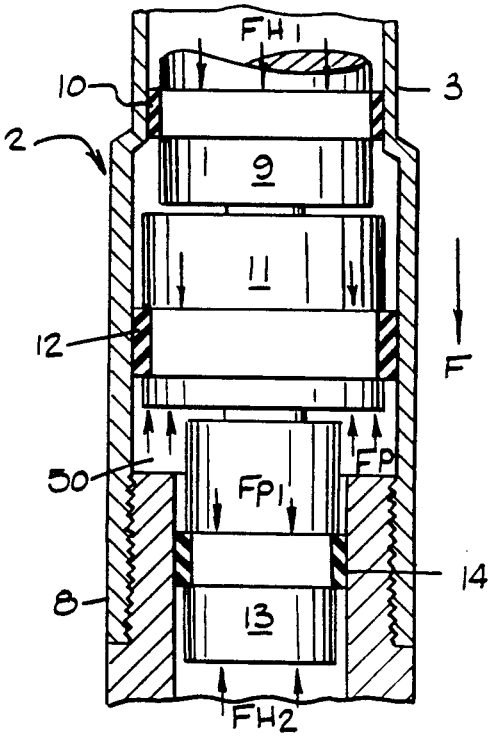
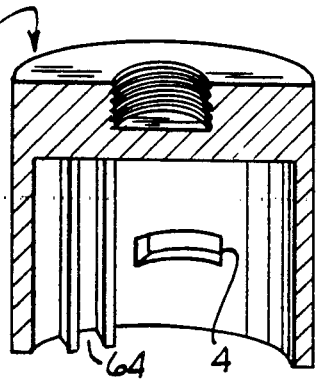
FIG. 9
FIG. 10
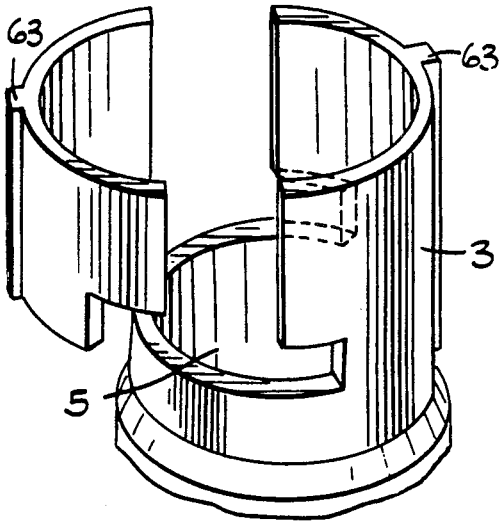
FIG. 11
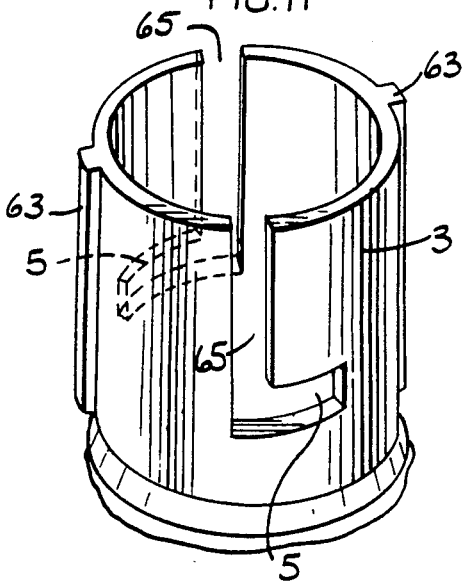

METHOD FOR SELECTIVELY OPERATING A WIRELINE TOOL RELEASING DEVICE

This is a division, of application Ser. No. 07/290,671 filed Dec. 27, 1988 now U.S. Pat. No. 4,909,321.

BACKGROUND OF THE INVENTION

1. Field of the Invention

The present invention relates to wireline operations which are typically performed within the production tubing within a well casing of a subsurface oil or gas well. More specifically, the invention is directed to a more efficient and dependable method and apparatus for retrieving long lengths of wireline, or running string, from the well when a well tool, which is attached to the remote end of the wireline, becomes lodged within the well and must be fished therefrom.

2. Description of Background and Relevant Information

Wireline operations in connection with oil and gas wells can require the use of great lengths of running string, or wireline, to the end of which can be attached any of a number of tools for performing any of a number of operations. Such operations are typically performed within the production tubing within the well casing. On occasion during the wireline operation, the tool can become lodged downhole such that the tool and the wireline connected thereto cannot be further moved within the tubing.

Prior to the present invention, the wireline operator merely had one release tool for removing the wireline, namely, the rope socket. The rope socket is simply a weak link in the wireline in the vicinity of the tool. If the tool becomes stuck downhole, tension in the wireline will either result in the dislodging of the tool or the parting of the wireline at the rope socket, so that when the lodged tool is attempted to be "fished" from the tubing, the "fishing" operation is not complicated by thousands of feet of wireline which might be coiled above the tool In many cases, however, when wireline equipment becomes stuck downhole, and the operator elects to "pull-out" of the rope socket, the wireline parts at a location other than at the rope socket. Due to this likelihood, or at least the great possibility that the wireline will part at some location other than at the rope socket, the wireline operator frequently elects, instead, to disconnect the wireline at the surface and to unthread the wireline from the tubing as the tubing is pulled out.

This necessarily results in increasing the time required for wireline operations and it delays subsequent well operations, thereby reducing efficiency.

The prior art includes various tools which are designed for remote release from a wireline or other particular devices which suspend such tools, such as, for example, a well casing section or a casing hanger or other downhole tools. Typically, however, these release tools are complicated assemblies of parts which are specifically designed for certain operations and are not intended merely for the selective disconnection of the wireline from the remote device or tool attached thereto.

For example, U.S. Pat. No. 4,003,434 to GARRETT et al. discloses a release tool for use with well tools such as packoffs and casing heads.

A split ring (or spring-biased locking pistons) engages under a lip on the well tool to be positioned downhole.

Fluid pressure in the casing acts on the upper surface of a piston to cam the split ring (or locking pistons) inwardly to disengage the release tool and permit its removal.

U.S. Pat. No. 4,273,372 to SHESHTAWY discloses a tool for lowering casing strings into the sea to a position near the ocean floor. Dogs which engage the internal surface of the casing are cammed inwardly and outwardly by a conical piston that is interconnected to said dogs by dovetail slots. The dogs are pre-loaded to the engagement position by spring pressure. Fluid pressure is applied from the surface through the handling string engaging the lower operative face of the conical piston, moving it upwardly to cam the dogs inwardly for disengagement.

U.S. Pat. No. 4,576,230 to TAPP et al. discloses an apparatus to temporarily set tools in a portion of a well casing. Toothed engaging elements are cammed outwardly from the body of the apparatus to frictionally engage the inner surface of the casing.

U.S. Pat. No. 4,603,743 to LINDSEY discloses an apparatus for setting a liner hanger in a well casing. Toothed engaging elements are hydraulically cammed outwardly to frictionally engage the inner surface of the casing.

Consequently, prior to the present invention there was a need for a releasable coupling device for use during wireline operation for universal use with various well tools, whose sole function is to permit the wireline to be selectively disconnected.

SUMMARY OF THE INVENTION

It is an object of the present invention to provide a method and apparatus for overcoming the aforementioned problems in wireline operations, particularly the problems encountered when a wireline tool becomes jammed downhole.

The apparatus of the present invention can be used, for example, when attempting to set or retrieve tubing plugs, when setting or placing wireline retrievable gas lift valves or other flow controlling tools such as, e.g., safety release valves, and could be run with swab cups.

The present invention permits the wireline operator to more dependably ensure the release of the wireline immediately above the tool to which it is connected, when the tool becomes lodged in an oil or gas well, and which gives the wireline operator a third option from the two mentioned above. That is, rather than having to rely upon the parting of the wireline at the rope socket, or, having to remove the wireline together with the production tubing from the well and then unthreading the wireline from the tubing, the operator can, with the present invention, dependably effect the disconnection of the wireline immediately above the bottommost tool.

The present invention permits wireline operations to be performed more efficiently by reducing the time required for resolving the problem of a jammed tool. Further, once the wireline is disconnected at the point of the device of the present invention, the operator can change out the wireline being used to a larger or newer line or can move in a larger line and the necessary tool for "fishing" the jammed tool.

According to a preferred embodiment of the present invention, the wireline uncoupling device includes an upper tubular portion for connection to a length of wireline which will be extended downhole from the surface of the well. The upper section of the lower tubular portion is telescopically received and is releasably connected to the upper tubular portion and is connected on top of the bottommost tool. The tubular portions are preferably cylindrical. The lower tubular portion carries a releasing mechanism, in the form of a piston assembly which reciprocates within the lower tubular portion and which selectively extends and retracts at least one dog through aligned apertures in the upper and lower tubular portions of the device. The releasing mechanism is actuated by applying hydraulic or pneumatic pressure to the device from the well surface. The device includes a precharge chamber below the piston assembly against which the applied surface pressure acts.

The precharge chamber is pressurized at the surface before the release device of the invention are lowered together with the tool and wireline, within the well. The pressure at which the precharge chamber is set is dependent upon the depth of the well operation and the fluid gradient to be encountered and is selectively set by the wireline operator. As an alternative to pneumatic pressure, a variable rate spring may be used to precharge the chamber.

By preselecting a desired surface releasing pressure and by precharging the tool prior to running the tool in the well with the well equipment attached thereto, the wireline operator can release the wireline, when and if necessary, by selectively applying a pressure greater than the precharge to the tubing, or casing. It is a further object of the present invention to permit the wireline release device to be operable in substantially any well and fluid density configuration likely to be encountered. For this purpose, the lower tubular portion of the device is removable as is at least a lower piston segment which is sealingly guided therein. This feature allows the operator to select a lower body diameter and accompanying piston segment and sealing rings of different effective cross-sectional areas to thereby alter the configuration of the precharge chamber.

The lowermost piston segment or balancing piston, includes an upper periphery which is in communication with the precharge chamber. The balancing piston segment is configured to include a passageway which extends from its lower part to the precharge chamber and is adapted to be connected to a pressure source for precharging the device to the selected pressure. A check valve is located in the passageway and a safety plug is provided on the end of the passageway after the releasing device has been precharged, to prevent any changes in precharge pressure.

The diameter of the balancing piston and accompanying sealing rings is less than that of the remaining pistons of the piston assembly so that under hydrostatic pressure conditions, the tool will be maintained in a locked, unstroked position.

The device is moved to its released position, and the piston assembly is stroked, upon the application of the predetermined hydraulic or pneumatic pressure which is applied from the surface of the well and which acts against the upper releasing piston segment which is located in the upper section of the lower tubular portion. Ports are provided in the wall of the upper tubular portion for communication with the upper piston segment. Likewise, ports are provided in the lower tubular portion for draining fluid therefrom as the piston assembly moves downwardly therein.

According to a further aspect of the present invention, the releasing mechanism preferably includes a pair of symmetrically located dogs which extend from slots within the upper releasing piston segment.

Each of the dogs includes a radial portion and an inclined portion which mate with respective radial and inclined portions of the slots in the upper piston segment. Upon the application of the necessary hydraulic or pneumatic pressure, the upper piston segment cams the inclined portion of the dogs inwardly to thereby retract the dogs from their respective openings in the upper tubular portion, to permit the uncoupling of the upper tubular portion from the lower tubular portion.

According to a further aspect of the present invention, the lower tubular portion of the releasing device includes a lower enlarged section which is preferably integral with the upper section. The outer diameter of the enlarged section is preferably the same as that of the upper tubular portion. A center piston segment is sealingly guided in the enlarged section and carries sealing rings which define the upper boundary of the precharge chamber. The diameter of the center piston segment, including its sealing rings, is the largest piston segment of the three.

According to a further aspect of the present invention, the upper tubular portion of the release device preferably includes vertical guides which mate with splines located on the telescopically received upper section of the lower tubular portion so that the upper and lower tubular portions of the release device do not rotate relative to each other, to thereby prevent the dogs from cocking and jamming within the device.

Various other features, advantages, and characteristics of the present invention will become apparent to those skilled in the art upon reading the following description in conjunction with the accompanying drawings.

BRIEF DESCRIPTION OF THE DRAWINGS

FIG. 4*a* is a cross-sectional elevation view of the upper part of the releasing device, illustrating the upper releasing piston segment holding the dogs in their extended position;

FIG. 4*b* is a similar view to that of FIG. 4*a*, illustrating the upper part of the releasing device with the upper releasing piston segment holding the dogs in their retracted position;

FIG. 5 is a perspective view of a dog;

FIG. 6 is a plan view of a dog;

FIG. 7 is a schematic illustration of the precharge chamber and piston assembly under hydrostatic pressure conditions, the piston assembly being in its unstroked position;

FIG. 8 is a schematic illustration of the precharge chamber and piston assembly with hydraulic or pneumatic pressure applied to move the piston assembly to its stroked position;

FIG. 9 is a cut-away perspective view of the upper tubular portion of the releasing device illustrating a dog opening and a guide for receiving a spline on the upper section of the lower tubular portion of the releasing device;

FIG. 10 is a perspective view of the upper section of the lower tubular portion illustrating the manner by which the section is constructed after the dogs are put in place;

FIG. 11 is a view similar to that of FIG. 10, illustrating an alternative construction.

DETAILED DESCRIPTION OF THE PREFERRED EMBODIMENTS

Figure 1A:
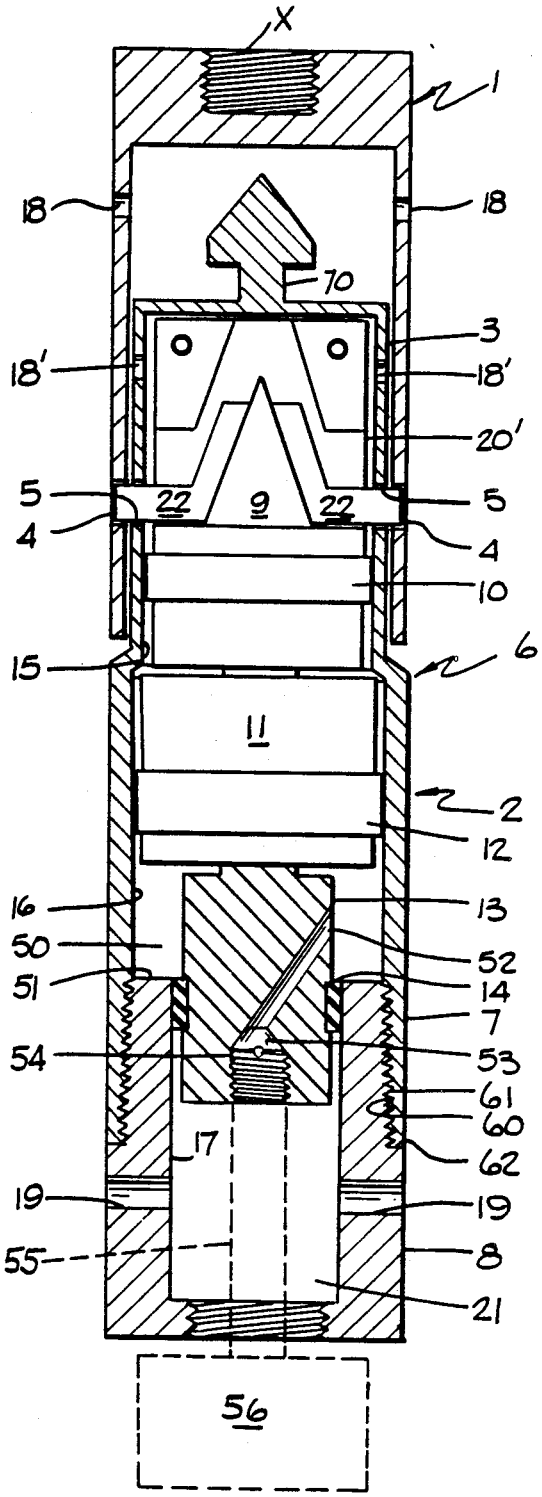
FIG. 1*a* is a cross-sectional elevation view of the release device in its locked, unstroked position.
Figure 1B:
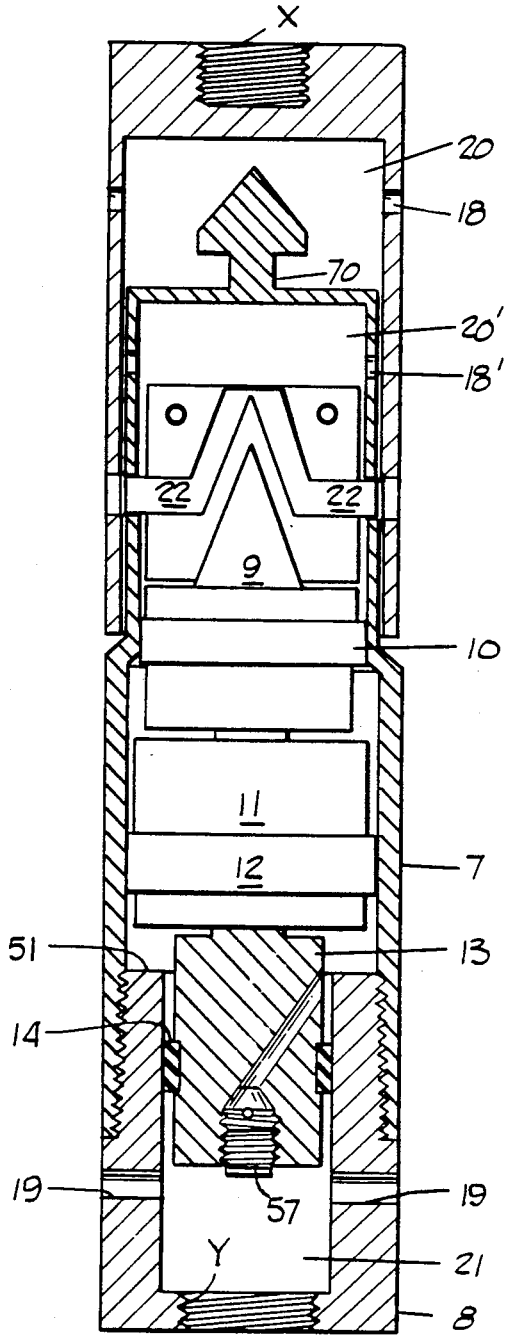
FIG. 1*b* is a cross-sectional elevation view of the release device in its released, stroked position.
Figure 2A:
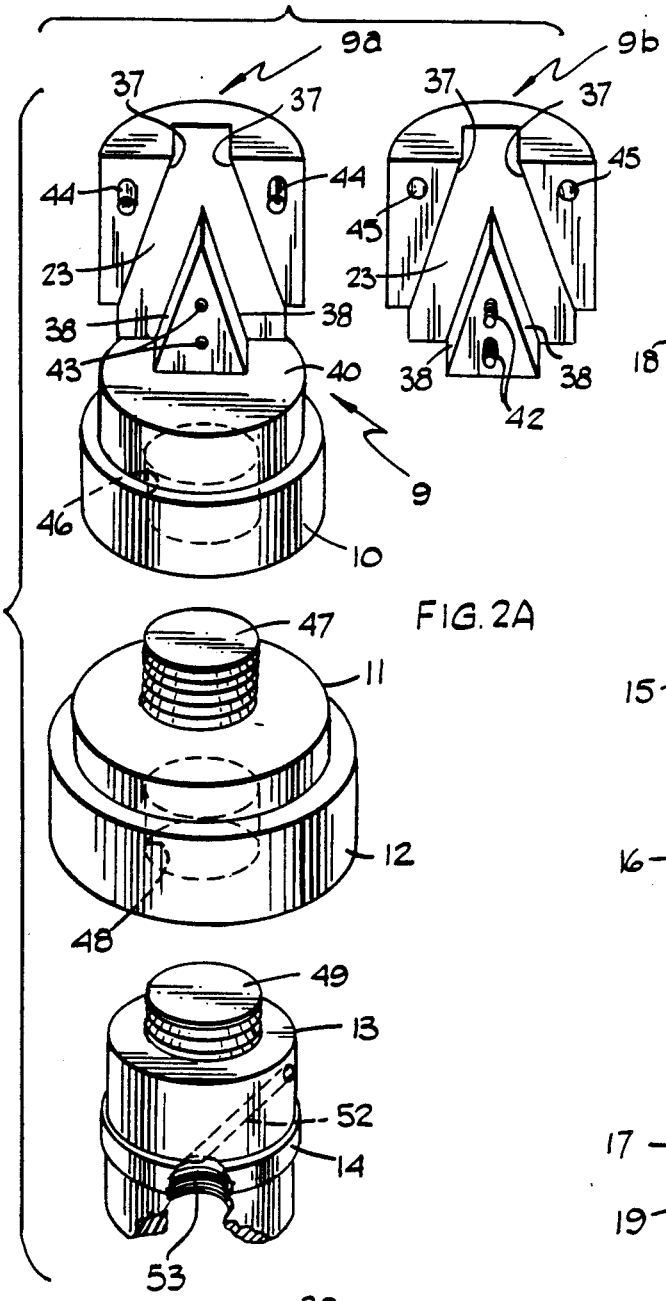
FIG. 2*a* is a exploded perspective view of the piston assembly of the releasing device.
Figure 3:
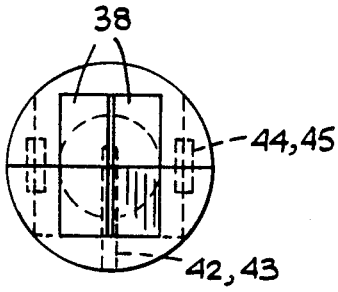
FIG. 3 is a plan view of the piston assembly.
Figure 2B:
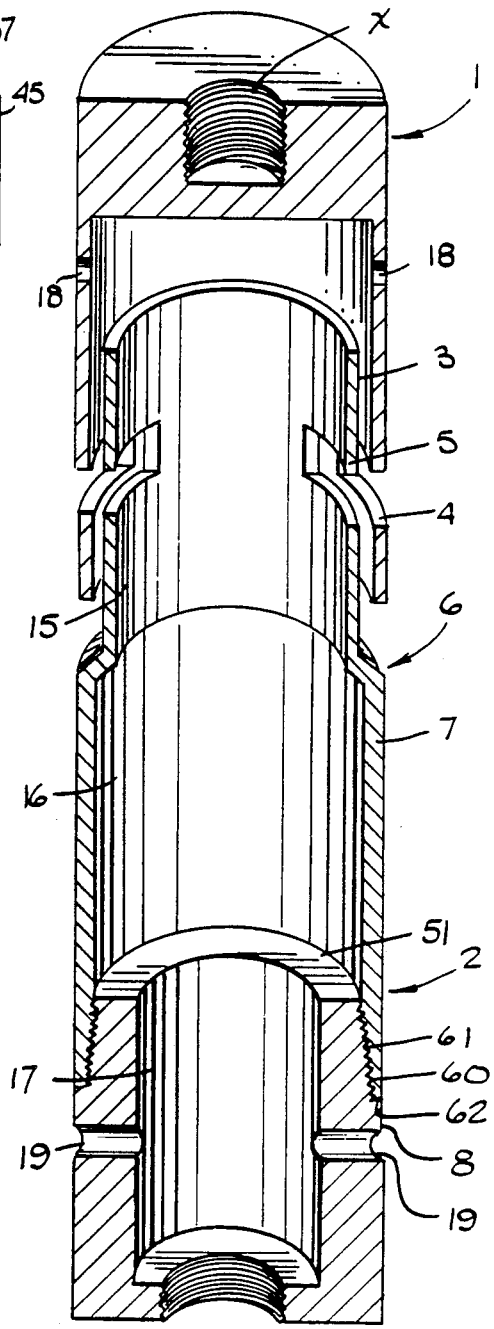
FIG. 2*b* is a perspective view of the upper and lower tubular portions of the releasing device.

The releasing device of the present invention is shown in its entirety in the cross sectional views of FIGS. 1*a* and 1*b*. FIGS. 2*a* and 2*b* illustrate, in exploded views, the components of the piston assembly and upper and lower tubular portions of the releasing device of the invention. The remaining figures illustrate particular aspects of the invention.

The releasing device of the present invention includes four primary, relatively movable components. Upper tubular portion 1 constitutes the first primary component and is connectable to a length of wireline by either a pin or a box connection X located in the top surface of upper tubular portion 1. A threaded female connection, e.g., is illustrated in FIGS. 1*a*, 1*b*. The outer diameter of upper tubular portion 1 is preferably no greater or not substantially greater than that of the wireline to which it is attached for tubing applications but can be substantially larger for use with larger tools.

The second primary component of the releasing device is the lower tubular portion 2 which includes an upper end section 3 which is telescopically received within the upper tubular portion 1 when the device is in its locked position, illustrated in FIG. 1*a*. The lower tubular portion 2 further includes an enlarged section 6 which includes a middle section 7 and a lower body or end section 8 which is releasably connected to middle section 7. The lower end of the middle section 7 has integral type threads 60 cut on the inside which mate with similar type threads 61 cut on the upper end of the lower end section 8. Further, the lower end of the middle section 7 butts up against a torque shoulder 62 on the lower end section 8 as the middle section 7 and end section 8 are screwed together to form a metal to metal seal.

The diameter of inner surface 16 of middle section 7 is larger than the diameter of inner surface 15 of upper end section 3 and, preferably, the diameter of inner surface 17 of lower end section 8 is less than that of the inner surfaces of each of the upper and middle sections.

The third primary component of the releasing device of the present invention is the piston assembly which includes, in the preferred embodiment, an upper releasing piston segment 9, a center piston segment 11, and a lower balancing piston segment 13. Each of the piston segments can be disconnected from the assembly by means of a respective threaded connection as shown. However, it is contemplated that for certain applications the upper releasing piston and the center piston can be made as a unitary segment.

A plurality of ports 18 are provided through the walls of the upper tubular portion 1 to allow hydraulic or pneumatic pressure to enter interior 20 of the upper tubular portion to actuate the tool, as explained more fully here below. Another plurality of ports 18' are provided in middle section 3 to permit that same pressure to have access to interior 20' of the lower tubular portion. Likewise, ports 19 are provided in the wall of the lower end section 8 to permit the fluid located within the interior 21 of end section 8 to drain therefrom. In addition, ports 19 permit borehole fluid pressure access to the bottom side of piston 13 enabling the required precharge pressure, discussed infra, to be reduced.

The upper releasing piston segment 9 is guided for movement in the upper section 3 against inner surface 15 by seal elements 10. Likewise, the center piston segment 11 is guided for movement within middle section 7 against inner surface 16 by seal elements 12. Further, the balancing piston segment 13 is guided for movement within lower end section 8 against inner surface 17 by seal elements 14. The seal elements 10, 12, and 14 are preferably formed from a suitable fairly rigid elastomeric material and are seated within respective peripheral grooves located within the outer peripheries of the respective piston segments. For each piston segment, the seal elements preferably comprise a plurality of adjacent seals (e.g., chevron seals). More preferably, an annular serpentine spring (not shown) may be used to axially compress the seals forcing them laterally outward into engagement with surfaces 15, 16 and 17.

With specific reference to FIGS. 4*a* and 4*b*, the releasable connection between upper tubular portion 1 and lower tubular portion 2 will be discussed, together with the fourth primary component of the present invention, viz., dogs 22. The cutaway view of FIG. 4*a* depicts the releasing device of the present invention in its locked position and the upper releasing piston in its unstroked position.

The releasing mechanism of the present invention consists of at least one dog 22, but preferably consists of a plurality of dogs 22 symmetrically arranged around the piston assembly. In the preferred embodiment, two such dogs 22 are employed. In their extended position, as illustrated in FIG. 4*a*, the dogs 22 project through aligned openings 4 and 5 located through the walls of upper tubular section 1 and upper end section 3 of lower tubular portion 2, respectively. In their retracted position, dogs 22 are withdrawn from openings 4 to a position at which their outer peripheries 36 are at least flush with the outer surface of upper end section 3, although still located within openings 5.

As illustrated in FIGS. 5 and 6, each dog 22 includes an inclined portion 26 and a radially projecting portion or nose 32. The nose 32 includes an arcuate surface 36 which is of a radius substantially equal to the radius of the outer surface of upper end section 3.

Each of the dogs 22 is received within a respective slot 23 located in upper releasing piston 9. Each of the slots 23 includes a radial opening portion 24 and an inclined opening portion 25.

Under normal hydrostatic conditions, within the wellbore fluid, as illustrated in FIG. 4*a*, substantially horizontal support surface 40 in each slot engages bottom surface 33 of its respective dog 22 and lower inclined surface 38 in each slot engages back surface 28 of a respective dog 22 to retain the dog 22 in its extended position, maintaining the releasing device in its locked, unstroked position.

When the upper releasing piston 9 is moved downwardly, by means which is explained below, upper inclined surface 37 in each slot of upper releasing piston 9 cams against front surface 27 of a respective dog 22, while nose 32 of the dog 22 is retained in opening 5, so that the dog 22 moves within upper releasing piston 9 to its retracted position, while support surface 40 moves downwardly away from dog 22, as shown in FIG. 4*b*.

Inclined portion 25 of slot 23 is preferably disposed at a relatively steep angle relative to the longitudinal center line A—A of the piston assembly to facilitate the force transmission from the upper releasing piston 9 to the dogs 22. This angle, according to the preferred embodiment, is in the range of approximately 10 degrees to 30 degrees. Further, the dogs 22 fit relatively snugly within the slots 23 of the upper releasing piston 9 to prevent the possibility of their cocking therein. Further, upper tubular portion 1 and upper tubular end section 3 are preferably guided by a spline 63 and guide 64 arrangement. See FIGS. 9–11.

The seals 10 of upper releasing piston 9 have a composite length such that when the releasing device is completely stroked, as illustrated in FIG. 1*b*, the seals remain in contact with the inner surface 15 of upper section 3. As illustrated in the exploded view of FIG. 2*a*, the upper releasing piston 9 is constructed in two pieces 9*a*, 9*b* so that the dogs 22 can be placed in slots 23 during the assembly of the device. The two pieces 9*a*, 9*b*, can be fastened together, after placement of dogs 22, with e.g., threaded fasteners 42, which are inserted through, and recessed within, openings in part 9*b* to be engagable with complementary threaded openings 43 in part 9*a*. Positioning studs 44 and complementary openings 45 are, preferably, also provided to facilitate proper alignment.

The center piston segment 11, according to the preferred embodiment, is screwed flush into the bottom of the upper releasing piston segment 9, as can be seen in FIGS. 1*a*, 1*b*. A threaded stud 47 can be provided in the center piston segment for reception in threaded receptacle 46 in upper releasing piston segment 9. Although, as indicated above, the center piston segment 11 can be made integrally with the upper releasing piston segment 9, it is preferable that it be made a discrete part so that it can be removed, if desired, and exchanged for a center piston segment having a different configuration for a purpose which will become apparent in the following description.

According to the preferred embodiment, the balancing piston segment 13 is screwed into the bottom of the center piston 11 by means of a threaded receptacle 48 and threaded stud 49. Seals 14 are positioned at a relatively low position on balancing piston segment 13 to thereby be spaced from the seals 12 on the center piston segment 11. The distance between the lowermost seal surface on the center piston segment 11 and the uppermost seal surface on the balancing piston segment 13 defines the height of a precharge chamber 50. The remainder of the precharge chamber 50 is defined by the inner surface 16 of middle section 7, the outer periphery of the balancing piston segment 13 located above the uppermost seal surface of seals 14, the lower peripheral portion of center piston segment located beneath the bottommost seal surface of seals 12, and the upper portion 51 of inner surface 17 of end section 8, particularly when the piston assembly is in its stroked position.

When the piston assembly is in its unstroked position, and the releasing device is in its locked position, the seals 14 of the balancing piston segment 13 are preferably substantially flush with the top 51 of the end section 8.

The precharge chamber 50 is pressurized at a preselected magnitude by the wireline operator. For this purpose, a passageway 52 is provided in the balancing piston segment 13 which extends from the upper periphery of the balancing piston 13, through the balancing piston and to a receptacle 53 which opens in the lower portion of the balancing piston segment 13. In the receptacle 53, a check valve 54 is provided which is preferably screwed into receptacle 53. The check valve 54 is offset into the balancing piston segment 13 so that a nipple 55, which is connected to a pressure source 56, can be screwed into the balancing piston segment so that the precharge chamber 50 can be suitably pressurized.

After the precharge chamber 50 has been pressurized, a plug 57 is preferably screwed into the receptacle 53 to prevent any changes in the precharge pressure.

A connection Y is provided for connecting the lower tubular portion 2 to the top of the well tool to be run. A female threaded connection is shown.

As indicated above, a significant aspect of the present invention is that the balancing piston segment 13 and lower end section 8 can be changed out to different sizes, thereby providing an end section 8 having a smaller or larger inner diameter, together with a balancing piston segment 13 likewise having a correspondingly smaller or larger diameter.

In operation, preferably before the releasing device of the present invention is connected to the wireline, the wireline operator suitably selects an appropriate balancing piston segment 13 and lower end section 8 combination, dependent upon the depth of the well and the liquid gradient. Also, the operator ensures that the balancing piston segment 13 is secured to the remainder of the piston assembly, middle piston 11 in the preferred embodiment illustrated, and that the lower end section 8 is securely fastened onto the lower tubular portion 2. If necessary, the operator can also exchange the center piston segment 13 to thereby alter the configuration of the precharge chamber 50. The operator then precharges the device to a selected pressure by inserting nipple 55 into the receptacle 53 located in the balancing piston segment 13 until the desired pressure is reached. The nipple 55 is then removed and plug 57 is inserted in the receptacle 53 to maintain the pressure level within the precharge chamber 50.

Once the releasing device is appropriately assembled and pressurized, the device is then attached to the top of the tool with which the releasing device of the present invention is to be run. The releasing device and tool are then attached to the wireline by means of connection X located at the top of the upper tubular portion 1, and the releasing device and tool are then lowered within the production tubing of the well. Of course the connecting sequence of the wireline, the releasing device, and the bottom tool can be varied from that indicated above.

An explanation of the operation of the device once it is placed within the well is made with reference to the schematic diagrams of FIGS. 7 and 8. FIG. 7 illustrates lower tubular portion 2 and the piston assembly to which the dogs 22 are connected for releasable connection between upper tubular portion 1 and lower tubular portion 2.

FIG. 7 depicts the normal hydrostatic condition of the device, i.e., before pressure is exerted from the surface of the well. In FIGS. 7 and 8, force FH1 is the hydrostatic pressure acting upon the upper releasing piston segment 9; force FH2 is the hydrostatic force acting upon the balancing piston segment 13; force Fp is the force acting upon center piston segment 11 due to the pressure within precharge chamber 50; and force F is the resulting force which, in FIG. 7, retains the piston assembly in its unstroked position and the releasing device of the present invention in its locked position. Preferably, the cross-sectional area of the seals on the balancing piston segment 13 is slightly less than that of the seals on the upper releasing piston segment 9.

It is apparent that without the ambient hydrostatic fluid acting on the balancing piston segment 13 by means of ports 19, the precharge pressure would be required to be extremely large, particularly in deep wells, to prevent the hydrostatic force from releasing the device.

Should the lowermost tool with which the device of the present invention is run become stuck within the tubing during wireline operations, and the wireline operator be unsuccessful in dislodging the tool, he can, by means of the present invention, choose to disconnect the wireline immediately above the tool by disconnecting the releasing device of the present invention. To accomplish the disconnection, the operator applies the preselected surface pressure to the tubing, whereby the hydraulic or pneumatic fluid enters the interior 20 of upper tubular portion 1 through ports 18 and 19, thereby exerting a greater downward force $F_{H1}$ on releasing piston segment 9 to thereby overcome the force $F_p$ and force $F_{H2}$ acting in opposition, as is schematically illustrated in FIG. 8. As the piston assembly moves downwardly, fluid is drained from the interior 21 of lower end section 8 through ports 19. It will be understood that the forces acting on opposite surfaces of seal 14 will balance out because of the equal pressures.

By applying the selected releasing pressure, the operator accomplishes the disconnection of the releasing device by means of the upper releasing piston segment 9 moving downwardly in upper tubular end section 3 such that inclined surfaces 37 of the slots 23 in the upper releasing piston segment cam the dogs 22 inwardly to thereby permit the upper tubular portion 1 to be released from lower tubular portion 2.

Subsequently, the wireline operator can then change out the wireline he was using to a larger or newer line or move in a larger unit to fish the tool which is lodged within the tubing. It is to be noted in this regard, that the upper tubular end section 3 of lower tubular portion 2 has a relatively long neck 70 that an overshot of a fishing tool can easily catch and adhere to, to thereby permit the stuck tool to be removed.

Alternatively, the operator can trip the tubing, but at least he will, by means of the present invention, be able to remove the great lengths of wireline inside the tubing and will not thereby need to unthread the wireline from the tubing once the tubing is removed.

FIGS. 10 and 11 depict two methods by which the upper tubular end section of the lower tubular portion 1 of the device according to the present invention can be constructed, depending upon the size of the releasing device. For devices which are 1 11/16 inches or smaller in outer diameter, it has been found that the upper tubular end section 3 is preferably made in two pieces above slots 5, as illustrated in FIG. 10, so that the dogs 22, held by upper releasing piston segment 9, can be inserted in the openings 5. The upper tubular end section is then welded together.

Alternatively, the dogs 22 can be made with a smaller width than that shown in connection with the preferred embodiment, and longitudinal slots 65 can be provided in the upper end section 3, along which the dogs can be moved during assembly. In this configuration, the splines 63 and guides 64 between the upper tubular portion 1 and the upper end section 3 ensure that the dogs stay in place when the tool is assembled and operated.

Releasing devices having an outer dimension of approximately 1 11/16 inches or smaller must be constructed in the aforementioned manner since, as explained above with regard to the preferred embodiment of the present invention, when in their retracted position, the dogs 22 are still retained within openings 5 such that, if the dogs are attempted to be placed within the upper tubular end section 3 without utilizing one of the aforementioned two methods, the dogs will strike together at the top of the upper releasing piston 9 before their noses 32 can be retracted sufficiently to clear the inside surface 15 of the upper tubular end section 3. Alternatively, the length of inclined portion 26 of the dogs 22 could be shortened to allow the dogs to clear the inner surface of the upper tubular end section 3. However, the possibility that the dogs 22 will then become cocked and jammed inside the upper releasing piston 9 during operation of the device becomes increasingly likely.

Releasing devices having an outer diameter greater than approximately 1 11/16 inches can be constructed such that the dogs 22 are placed inside the upper tubular end section 3 without any special construction of end section 3 as mentioned above and illustrated in FIGS. 10 and 11. That is, for such larger sized devices, once the dogs have been located within the upper releasing piston 9, the piston assembly can then be inserted within the lower tubular portion and the dogs 22 can be retracted such that they will clear inner surface 15 of the upper tubular end section 3.

Figure 12:
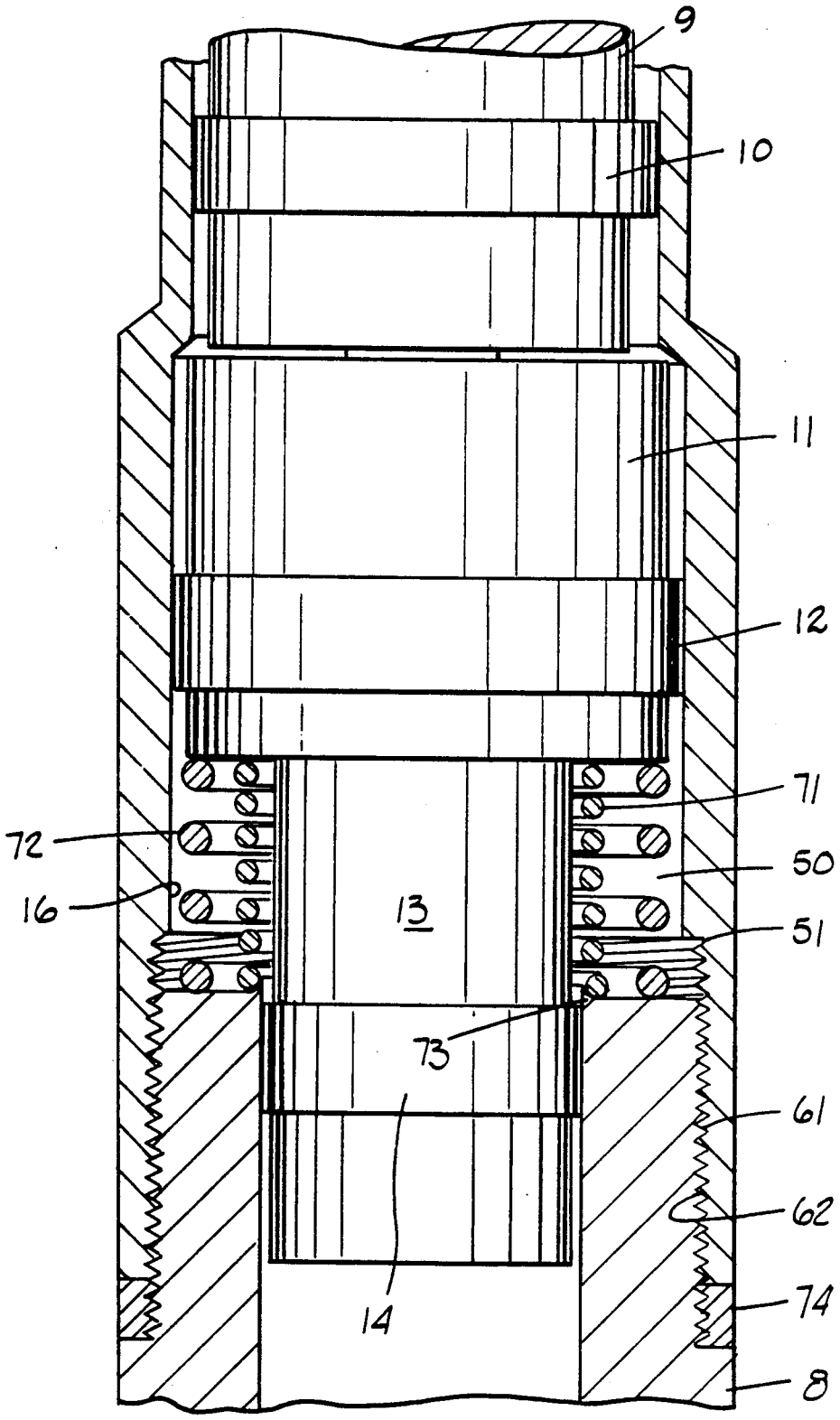
FIG. 12 is a schematic side view in partial section of yet another embodiment of the present invention.

As mentioned earlier, a variable rate spring can be used to create a portion or all of the preload on piston 11. FIG. 12 depicts a combination of several methods which may be used to vary the amount of preload. As shown there, a first inner spring 71 is comparitively soft with a first spring rate. A second outer spring 72 may be added to spring 71, outer spring 72 being stiffer with a second higher spring rate. It is preferred that an annular lip 73 be provided on surface 51 to maintain the position of inner spring 71. A similar protrusion could be provided to position outer spring 72.

In addition or in lieu of adding a second spring to provide the desired variability in spring rate, a series of spacer rings 74 may be added to effectively decrease the rate of a particular spring by backing reaction surface 51 away from piston 11. These spacer rings will preferably be threaded to engage threads 61 of end section 8 and have a plurality of thickness to adjust the position of surface 51 to provide the desired preload to correspond with the particular borehole conditions.

Thus, it is seen that the method and apparatus of the present invention achieves the objects and advantages mentioned as well as those which are inherent therein. While certain preferred embodiments of the present invention have been illustrated and described for the purposes of the present disclosure, changes in the arrangement and construction of parts may be made by those skilled in the art, which changes are encompassed within the scope and spirit of the present invention as defined by the following claims.

I claim:

1. A wireline method for use in a wellbore and incorporating a wireline having a releasing device which includes a first tubular piston connectable to said wireline, a second tubular portion releasably connectable, at a first end, to said first portion and, at a second end, to a downhole tool, a releasing mechanism operable in response to a change in pressure for releasably connecting said second tubular portion to said first tubular portion, a precharge chamber located within said second tubular portion, and means for adjustably pressurizing said precharge chamber to apply a force against said releasing mechanism to prevent said first and second tubular portions from being disconnected, said method comprising:

(a) selecting a desired releasing pressure magnitude and pressurizing said precharge chamber of said releasing device to said magnitude to apply a given force against said releasing mechanism;

(b) connecting said releasing device to said downhole tool and to said wireline;

(c) extending said wireline, with said releasing device and said downhole tool attached thereto, into the wellbore; and (d) maintaining the wellbore pressure at a level which is insufficient to overcome the force applied against the releasing mechanism if it is not desired to operate the releasing device downhole.

2. The method of claim 1 further comprising:

(e) applying hydraulic or pneumatic pressure to the wellbore from the surface to overcome said given force to release said first tubular portion of said releasing device from said second tubular portion of said releasing device from said second tubular portion of said releasing device; and (f) withdrawing said wireline and said first tubular portion of said releasing device from said wellbore.

3. A method for running a wireline operated tool in a wellbore so as to selectively affect complete release of the tool or maintain the tool attached to the wireline from which it is suspended at a downhole location in the wellbore, wherein a releasing device is carried on the wireline and is coupled with the wireline operated tool, the releasing device having a first portion releasably connected to the wireline, a second portion releasably connected to the tool, a hydraulically operated release means operable in response to a predetermined pressure level in the wellbore for holding in its unoperated condition said first portion and said second portion against relative movement to one another, and adjustable means for applying a coupling force of a predetermined magnitude against said hydraulically operated releasing means to maintain said first and second portions connected together against movement, comprising the steps of;

at the surface, adjusting the means for applying a coupling force against said hydraulically operated releasing means to a level which will hold said first and second portions against movement under ordinary ambient pressure conditions encountered in the wellbore;

lowering the wireline operated tool and releasing device into the wellbore on the wireline; and maintaining the borehole pressure at an ambient level which will not operate the releasing device when it is not desired to release the second portion from the first portion.

4. The method of claim 3 wherein if it is desired to operate the release means, further including the step of changing the pressure at the upper end of the wellbore to operate the hydraulically operated release means downhole to totally separate the first portion from the second portion and thereby release the wireline operated tool from the wireline.

5. The method of claim 4 and further including removing the wireline from the wellbore.

6. The method of claim 4 wherein if it is desired to remove the released portion of the tool from the wellbore, further including the steps of attaching a retrieving means to a wireline, and lowering the retrieving means into the wellbore to connectibly engage the released portion, and retrieving the wireline and released portion from the wellbore.

7. The method of claim 3, wherein the adjustable means for applying a coupling force against said releasing means is comprised of a precharged chamber which provides a predetermined hydraulic force against said releasing means and further including the step of, at the surface, pressuring said precharged chamber to a sufficient level to maintain said releasing means in an unoperated condition under the normally expected hydrostatic pressures to be encountered in the wellbore.

8. The method of claim 3 wherein said means for applying a predetermined force against said releasing means is accessible from the exterior of the wireline releasing device and further including the step of, at the surface, without disassembling the wireline releasing tool, adjusting in accordance with expected hydrostatic ambient pressures in the wellbore the means for applying a coupling force of a predetermined magnitude to maintain said first and second portions connected together against movement.

9. A method for running a wireline operated downhole tool in a wellbore having provisions for selectively operating a wireline releasing apparatus for releasing a wireline from the downhole tool suspended from the releasing apparatus and having an upper tubular member with a first aperture, means for connecting the wireline to said upper tubular member, a lower tubular member having an upper portion telescopically mated with said upper tubular member, said upper portion having a second aperture, latch means operable between a first position within the first and second apertures for holding the upper and lower tubular members against relative movement and a second position within only one of said apertures for releasing said upper and lower tubular members for relative longitudinal movement, and means operable only in response to a change in hydrostatic pressure in the wellbore for operating the latch means, comprising the steps of:

calculating the ambient hydrostatic pressure to be encountered at the downhole operating depth in the wellbore;

at the surface, conditioning the means for operating the latch means to be inoperable in response to expected ambient hydrostatic pressures encountered in the wellbore, lowering the downhole tool into the wellbore on the wireline releasing apparatus; and maintaining the wellbore at a hydrostatic pressure level which is calculated to prevent the releasing apparatus from being operated.

10. The method of claim 9 and further including adjusting the hydrostatic pressure in the wellbore to a level to operate the latch means if it is desired to release the downhole tool in the wellbore.

11. A method for running a wireline operated well tool and for selectively releasing the well tool or maintaining the well tool attached to a wireline at a downhole location in a wellbore comprising the steps of;

lowering the well tool into the wellbore on a wireline with the well tool being connected to the wireline by means of a hydraulically operated latch mechanism which is operable to release the tool under hydrostatic pressure conditions of a predetermined level;

prior to lowering the well tool into the wellbore, calculating the expected ambient hydrostatic pressure to be encountered at the depths at which the well tool is to be operated;

prior to lowering the well tool into the wellbore, conditioning the latch mechanism to be inoperable to release the tool under the expected ambient hydrostatic pressures to be encountered in the wellbore; and maintaining the borehole pressure at a level which will not operate the hydraulically operated latch mechanism if it is not desired to release the well tool from the wireline.

* * * * *

UNITED STATES PATENT AND TRADEMARK OFFICE

CERTIFICATE OF CORRECTION

PATENT NO. : 4,997,041

DATED : March 5, 1991

INVENTOR(S) : Allen R. Petree

It is certified that error appears in the above-identified patent and that said Letters Patent is hereby corrected as shown below:

Column 11, line 1 "piston" should be --portion--.

Signed and Sealed this

Twenty-eighth Day of July, 1992

*Attest:*

DOUGLAS B. COMER

*Attesting Officer*

*Acting Commissioner of Patents and Trademarks*